US005473868A

United States Patent [19]

Martelli

[11] Patent Number: 5,473,868

[45] Date of Patent: Dec. 12, 1995

[54] CARTON OPENING AND FEEDING APPARATUS

[75] Inventor: Antonio Martelli, Bologna, Italy

[73] Assignee: O.A.M. S.p.A., Rastignano, Italy

[21] Appl. No.: 404,526

[22] Filed: Mar. 15, 1995

[30] Foreign Application Priority Data

Mar. 23, 1994 [IT] Italy ..... BO94A0125

[51] Int. Cl.[6] ..... B65B 43/24

[52] U.S. Cl. ..... 53/566; 53/381.1; 493/312; 493/313; 493/309

[58] Field of Search ..... 493/312, 313, 493/309; 53/566, 381.1, 458, 564

[56] References Cited

U.S. PATENT DOCUMENTS

| | | | |
|---|---|---|---|
| 3,698,154 | 10/1972 | Woodruff et al. | 53/566 |
| 4,685,275 | 8/1987 | Nigrelli, Sr. | 53/566 |
| 4,735,600 | 4/1988 | Prewke et al. | 53/566 |

FOREIGN PATENT DOCUMENTS

| | | |
|---|---|---|
| 0027968 | 1981 | European Pat. Off. . |
| 3010891 | 1980 | Detschland. . |
| 2103857 | 1972 | France. . |

*Primary Examiner*—John Sipos
*Assistant Examiner*—Gene L. Kim
*Attorney, Agent, or Firm*—McAulay Fisher Nissen Goldberg & Kiel

[57] ABSTRACT

A device for opening a tubular blank into a container, comprising an opening station, a packaging line and pairs of suction cups rotated stepwise for gripping the containers and carrying them to a position on the packaging line. The opening station is equipped with a support surface and opening blade arms hinged sidewise to each other. The packaging line features a conveying surface and two pairs of longitudinal endless chains equipped with vertical prongs and rotating stepwise so as to convey the containers obtained from the blanks which are held in seats delimited by the prongs.

9 Claims, 5 Drawing Sheets

CARTON OPENING AND FEEDING APPARATUS

BACKGROUND OF THE INVENTION

The present invention relates to packaging articles inside containers obtained from flat folded tubular blanks. In particular, the present invention relates to a device for opening these carton blanks and for feeding these blanks already opened to a series of working stations along a packaging line.

DESCRIPTION OF THE PRIOR ART

It is known that automatic apparatuses are used to package articles inside containers. These apparatuses work with high speed and carry out different techniques, that generally require one or more working stations through which the containers obtained from flat folded tubular blanks are conveyed.

Upstream of the series of stations, there are always devices for opening the blanks, which are stored in a stack in a magazine, to set up containers.

An example of a device of this type is the one produced by the same Applicant in which a conveying surface is delimited by two parallel longitudinal guides and a magazine, containing flat folded tubular blanks, is situated at the inlet of this conveying surface, at higher level.

A device formed by a pair of intermittently oscillating arms, is situated directly under the magazine for withdrawing the lowermost blank from the stack situated therein. Each arm has a pair of suction cups connected to a suction system, aimed at gripping the blank surface.

This device repeatedly places a blank in a feeding station situated at the inlet of the conveying surface.

Two endless chains, arranged at both sides of the conveying surface, are driven stepwise, in phase relation with the withdrawing device so as to move along a section coplanar with the conveying surface, by a suitable length.

The chains have lugs turned outward, regularly spaced apart so as to engage the blank set in the feeding station to convey it up to an opening station, situated along the conveying surface.

During this convey, the blank is handled by preparing means, situated alongside the conveying means, that unfold the blank end panels.

The unfolding device is formed by two blades situated transversally and horizontally one upon another and hinged one to another, and is placed beside the opening station.

Also the blades move stepwise, in phase relation with previously mentioned devices, between a retracted position, clear of the conveying surface, and an advanced position in which they insert inside the blank.

Moreover, the upper blade can rotate around the hinge connection between it and the lower blade, by an angle slightly bigger than 90 degs, so as to unfold the blank and setting it up to the container configuration.

Groups of vertical prongs are situated below the conveying surface, between the guides that form it, so as to delimit quadrilateral seats that house containers just formed.

One of these seats is arranged flush with the opening station, while the others are located in downstream predetermined positions.

These groups of prongs can move vertically, in phase relation with the unfolding device, until they catch the container situated thereover.

The prongs can translate also longitudinally so as to move the containers by a prefixed distance long enough to free the opening station and to allow setting up of another container.

In this way, the containers are made to move forward stepwise along the conveying surface, in synchrony with the production steps.

Afterwards, the groups of prongs translate downward and then backward so as to repeat the above described cycle with the subsequent container.

Further pairs of vertical prongs turned downwards are situated over the conveying surface, arranged in longitudinal rows and in central position.

These prongs can translate vertically up to catch, guide and keep in position, the containers when they are not held by the lower prongs.

The device for opening blanks and conveying the containers obtained therefrom, is efficient and reliable, specially with small blanks.

However, machine setup and maintenance operations can provoke some problems, because of the large number of devices that move synchronously, specially when the working speed is high.

SUMMARY OF THE INVENTION

The object of the present invention is to provide a device for opening flat folded blanks to form containers, and for feeding them to a packaging line, the device being easy to produce, allowing quick and simple set up and maintenance operations, and also being efficient independently from the size of the blank to be handled, and finally easily adaptable to different shapes and sizes of the blanks.

The above mentioned objects are achieved by means of a device for opening a flat folded tubular blank to set up a container, said device comprising: an opening station provided with a support surface substantially horizontal and with opening means situated transversally and parallel to said support surface, said opening means moving with stepwise reciprocating motion between a retracted position, in which they are positioned clear of said support surface, and an advanced position in which said opening means are inserted inside said flat folded tubular blank, with said opening means including a lower blade and an upper blade hinged to said lower blade so that it can rotate from a closed position to an opened position to open said blank; at least one packaging line, provided with a conveying surface situated next to, and at higher level of said support surface with a connecting guide bar therebetween, said packaging line being also provided with two pairs of longitudinal endless chains situated at both sides of said conveying surface, each endless chain being driven stepwise by a related toothed wheel, with the upper runs of said chains substantially flush with said conveying surface, and with each chain being provided with a plurality of prongs turned outward, regularly spaced apart, and defining seats aimed at housing said containers; withdrawing means, concentric to said toothed wheels and located between them, aimed at engaging adjacent walls of each container in correspondence with said support surface so as to guide them to a starting position in said support surface up to a release position in the conveying surface, said withdrawing means cooperating with said opening means to open the blank.

BRIEF DESCRIPTION OF THE DRAWINGS

The characteristic features of the present invention are pointed out in the following description with reference to the enclosed drawings, in which.

DESCRIPTION OF THE PREFERRED EMBODIMENTS

Figure 1:
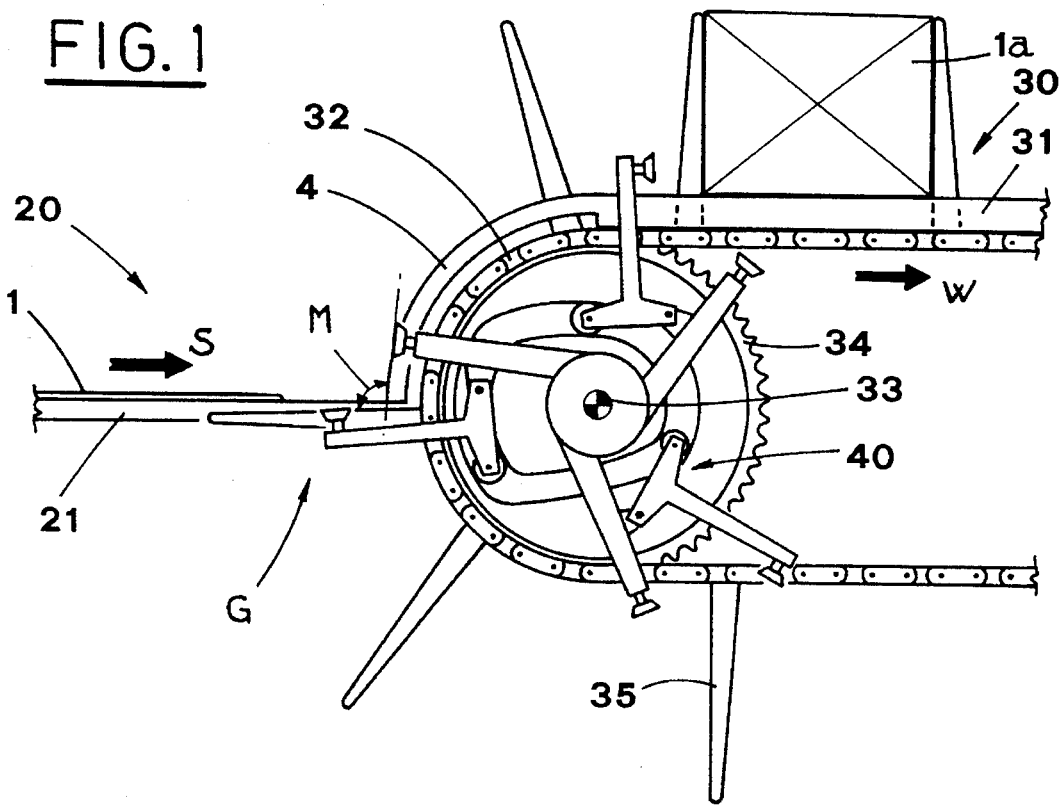
FIG. 1 shows a schematic cross sectional view of the device for opening and conveying blanks, in accordance with the present invention.
Figure 2:
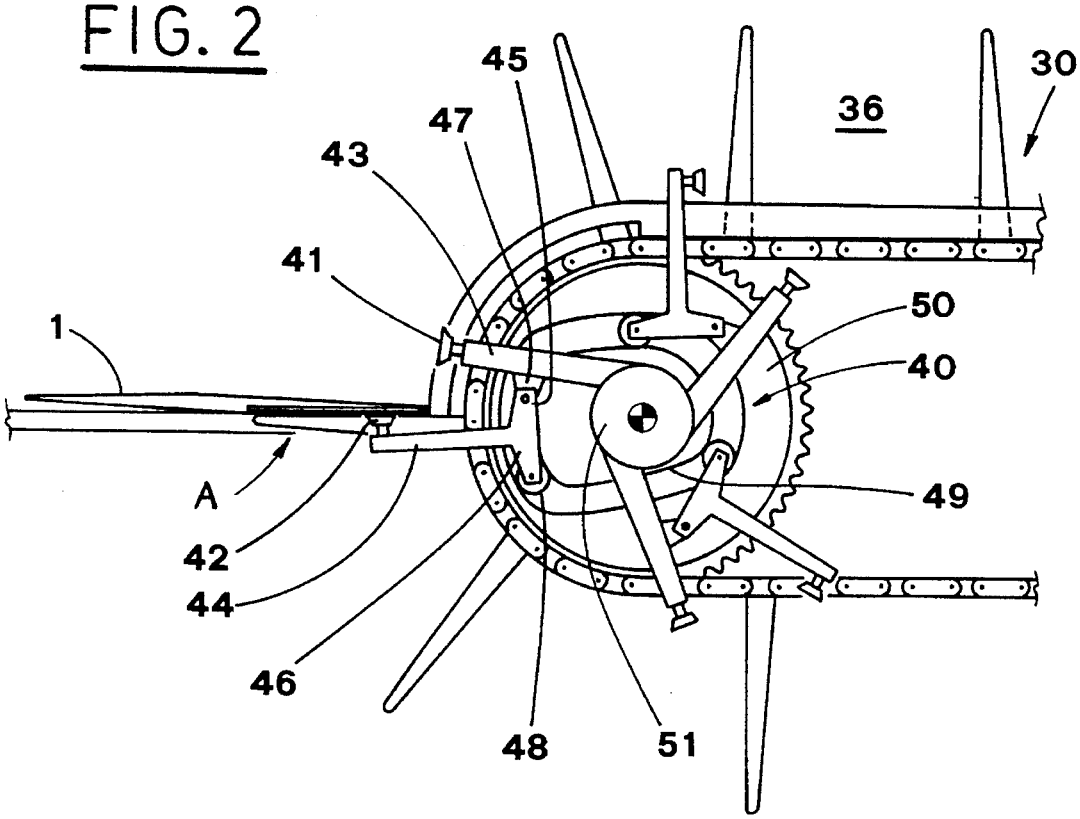
FIGS. 2, 3, 5 and 6 show subsequent steps in which a blank is opened and the set up container is conveyed.

With reference to the FIGS. 1 and 2, a flat folded blank 1 is carried to an opening station 20, by feeding means, not shown, since they are known. The opening station 20 is set along a support surface 21, in a direction S.

The blank 1 strikes against a stop defined by the lower end of an arch-shaped guide bar 4.

The opening station 20 has also opening means 22, which are substantially coplanar with the support surface 21 and arranged crosswise with respect thereto.

The opening means 22 are made to translate by a carriage 23, with a stepwise to and fro motion along guides 26, between a retracted position, not shown, and an advanced position E, in which the opening means 22 are introduced inside the blank 1.

Figure 5:
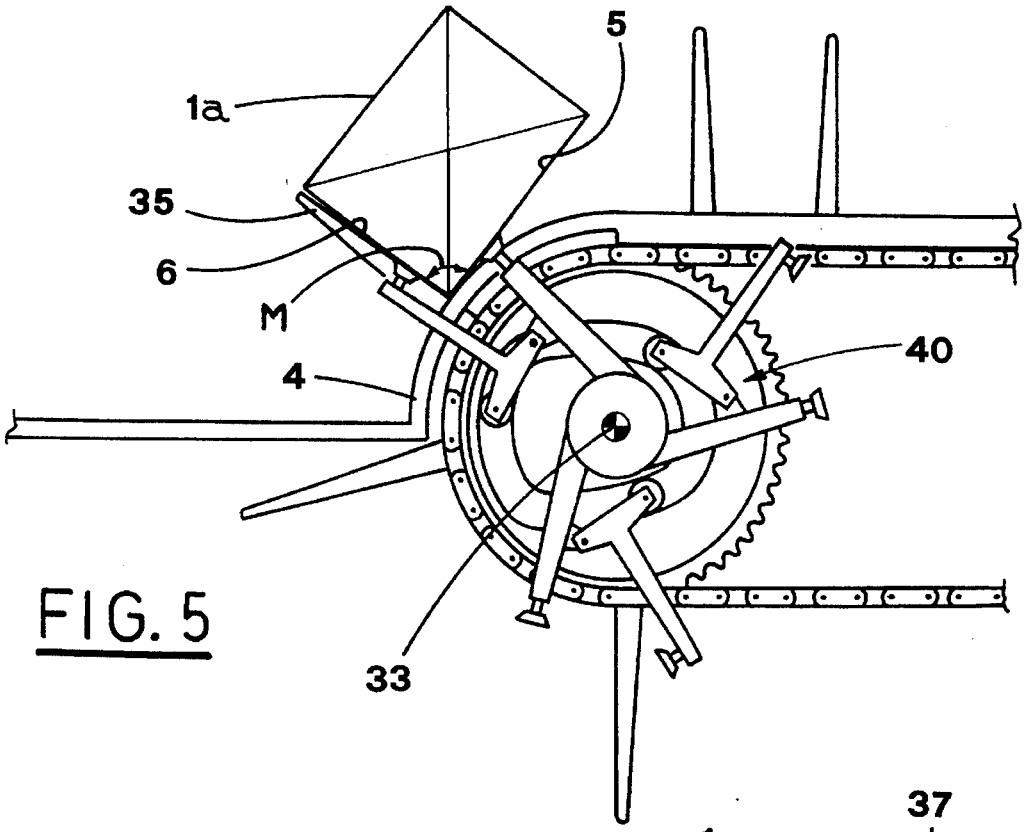

The opening means are constituted by a lower flat blade 24, rigidly fastened to the carriage 23, and an upper blade 25, hinged sidewise to the lower blade 24 and rotated, by an arm 27, between a closed position A and an open position B so as to open the blank 1 to set up a container 1*a* (see FIG. 5).

Right downstream of the opening station 20 there is a packaging line 30, featuring a longitudinal conveying surface 31, placed over the support surface 21 and linked thereto by the arch-shaped guide bar 4.

Figure 4:
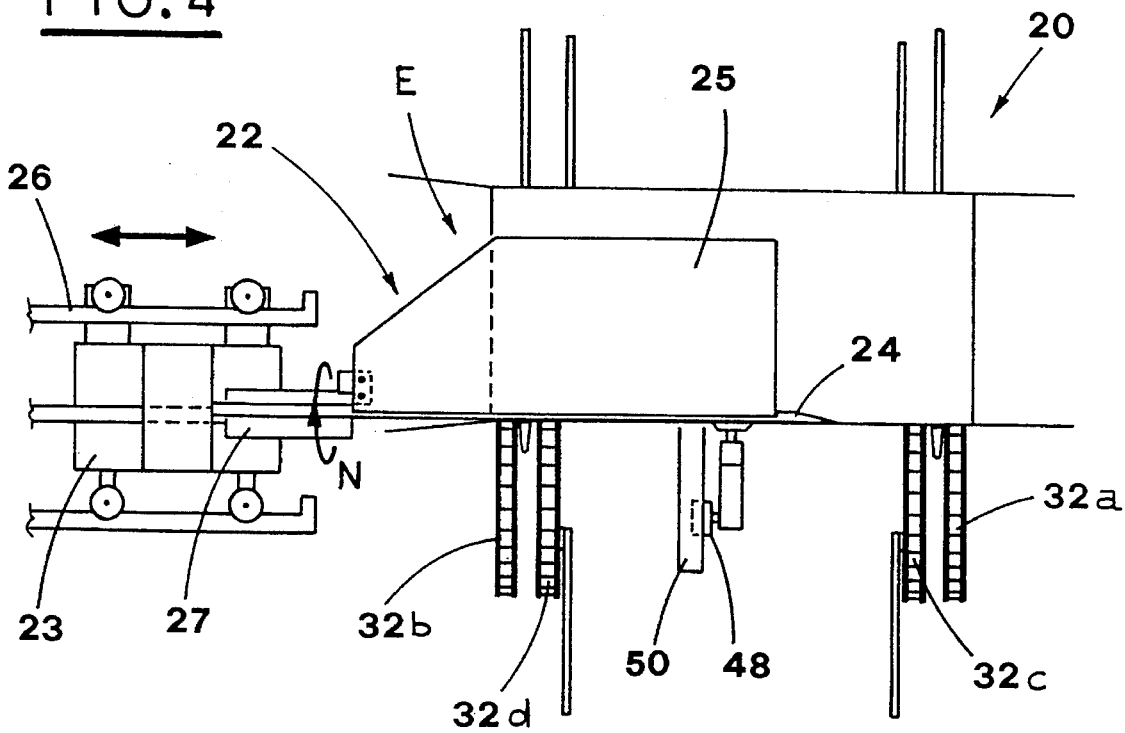
FIG. 4 shows a sectional view taken along line IV—IV of FIG. 3.

The packaging line 30 has also two pairs of longitudinal endless chains 32, situated at both sides of the conveying surface 31 and comprising outer chains 32*a*, 32*b* and inner chains 32*c*, 32*d* (see FIG. 4). The upper runs of the chains are substantially flush with the conveying surface.

Toothed wheels 32 drive these chains 32 to rotate, stepwise and in synchrony with one another, in direction W, in phase relation with the opening means 22.

Each of the chains 32 is also equipped with a plurality of prongs 35, extending outward, regularly spaced apart and defining consecutive seats 36 aimed at housing the containers la coming from the opening station 20.

A longitudinal guide 37 is situated over the conveying surface, parallel thereto and far therefrom by a distance that is not smaller than the height h of the container 1*a*.

The longitudinal guide 37 cooperates with the prongs 35 and the conveying surface to maintain the opened position of the containers.

Means 40 for withdrawing the container 1*a* are positioned between the inner chains 32*c*, 32*d* at the inlet of the conveying surface 31.

The withdrawing means 40 are equipped with a plurality of pairs of suction cups 41, 42, the suction cups of each pair being arranged in radial symmetry with respect to an axis 33 coincident with the rotation axis of the toothed wheels 34.

The said pairs of suction cups 41, 42 can rotate stepwise in phase relation with the pairs of chains 32 and with opening means 22.

The suction cups 41, 42 of each pair include a main suction cup 41, situated at the end of a related arm 43 rigidly fastened to a shaft 51, and a secondary suction cup 42 placed laterally near the outer end of a driven arm 44.

On its opposite end, the arm 44 has two transversal opposed extensions, respectively a first extension 45 and a second extension 46.

The first extension 45 is pivoted to a bracket 47 rigidly fastened to an intermediate section of the arm 43.

The second extension 46 bears an idling roller 48 running in a first closed loop groove cam 49 made in a disc 50 concentric to the shaft 51 and so shaped as to determine, in every moment, the relative position of the secondary suction cup 42 with respect to the main suction cup 41.

Figure 6:
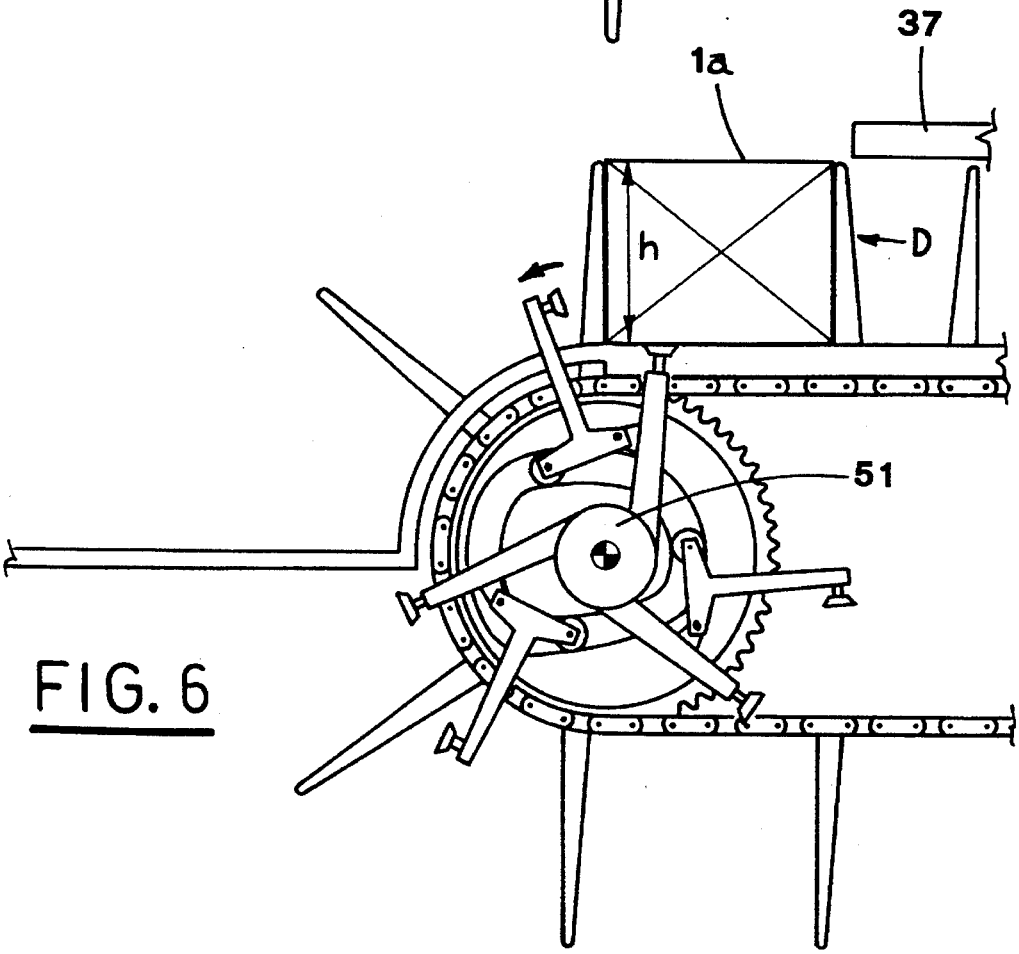

In normal state, the said suction cups, respectively main suction cup 41 and secondary suction cup 42, are arranged according to a 90 degs angle M with respect to each other (FIG. 5); the rotation of the secondary suction cup 42 is delayed by the first cam 49 so that the angle M increases when the suction cups are in position G waiting for the blank 1 (see FIG. 1) and when they are in position D in which the blank 1 has already been released (see FIG. 6).

Figure 7A:
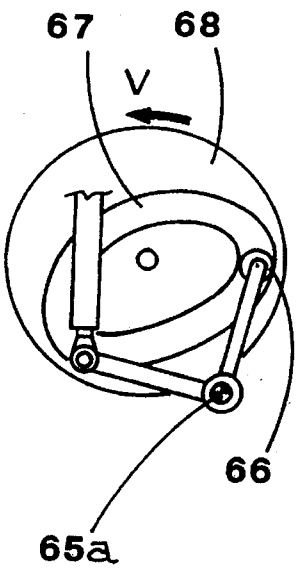
FIGS. 7*a* and 8*a* show a fragmentary view of correcting means, as seen from direction X and depicted in the working steps shown respectively in FIGS. 7 and 8.
Figure 7:
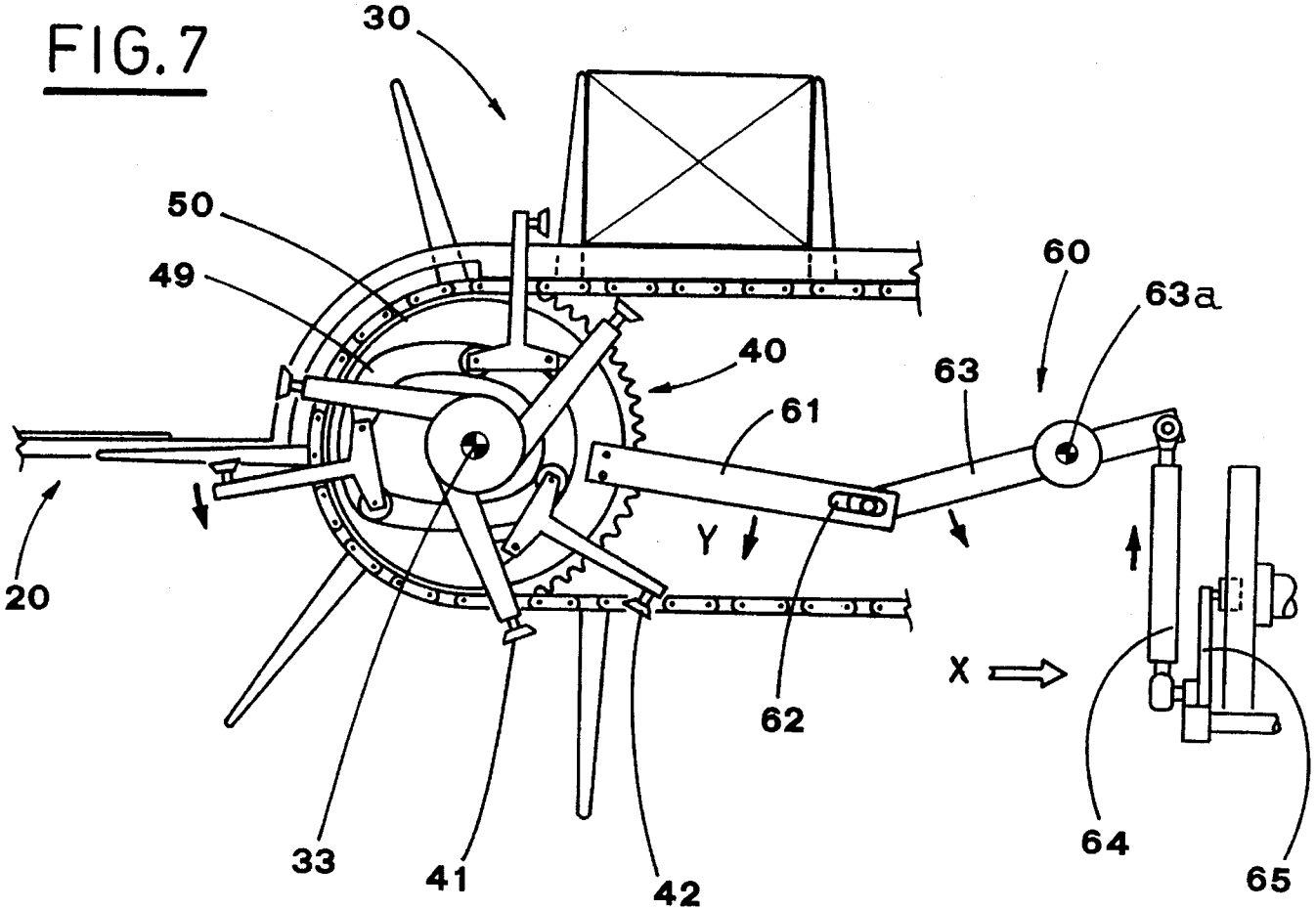
FIGS. 7 and 8 show a side cross sectional view of a different embodiment of the device according to the present invention, depicted in two working steps.
Figure 8A:
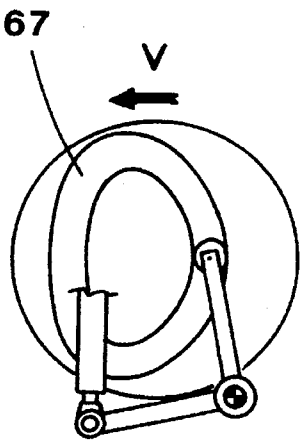
Figure 8:
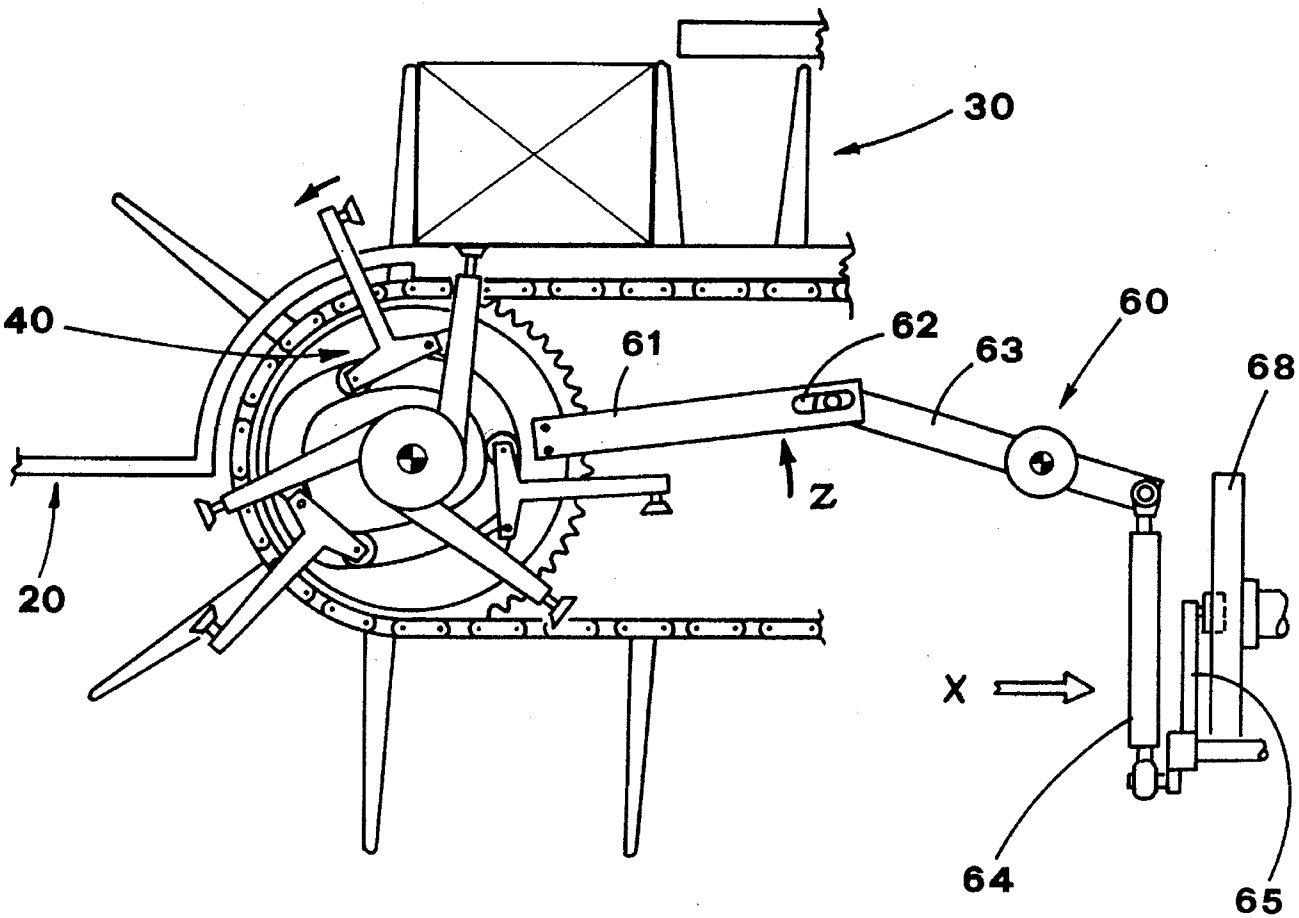

In a different embodiment of the proposed device, shown in FIGS. 7 and 8, the correction means 60, in phase relation with the withdrawing means 40, optimise the delay of the rotation of the secondary suction cup 42 in the said positions G and D.

In this different embodiment the disc 50 is free to rotate around its own axis 33.

The correction means 60 comprise a first arm 61 with one end rigidly fastened to the disc 50 close to the edge thereof, and with the other end slidably connected, by a slot 62, to the end of a first rocking rod 63 that oscillates around an axis 63*a* and, at the other end, is pivoted to a second arm 64.

The second arm 64 is pivoted to one end of a second rocking rod 65, that oscillates around its axis 65*a* (FIG. 7*a*) and features, at the other end, an idling roller 66.

The roller 66 runs in a second closed loop groove cam 67, made in the correction disc 68. The disc is rotated in a direction V by control means, not shown.

The shape of the second groove cam 67 is such that the first arm 61 moves in direction Y and consequently the disc 50 rotates in clockwise direction by a predetermined angle corresponding to a portion of the correction disc 68 rotation. When instead the first arm 61 moves in direction Z, the disc 50 rotates in counterclockwise directions by another predetermined angle corresponding to a portion of the correction rotation of disc 68 (FIG. 8*a*).

A working cycle of the device for opening and conveying blanks is described beginning from an operative step in which a blank 1 is conveyed along the support surface 21 to be opened and to form a container.

The opening means 22 are in retracted position with the upper blade 25 in its closed position A.

The chains 32 are motionless and a pair of prongs 35, of e.g. the outer chains 32*a*, 32*b*, are situated right under the support surface 21.

Also the withdrawing means are motionless, with the stationary arm 43 substantially horizontal.

As a consequence, the main suction cup 41 is turned toward the opening station 20 and the secondary suction cup 42 is situated right under the support surface 21.

The wall 6 of the blank 1 is gripped by the secondary suction cup 42 after the blank has struck against the base of the guide bar 2.

Then, the opening means 22 are operated and moved from the initial retracted position to the advanced position E, so that the lower blade 24 and the upper blade 25 are inserted in the blank 1.

Then, the blank 1 is opened by rotation of the blade 25 in direction N in agreement with the direction W of the motion of the chains 32.

Figure 3:
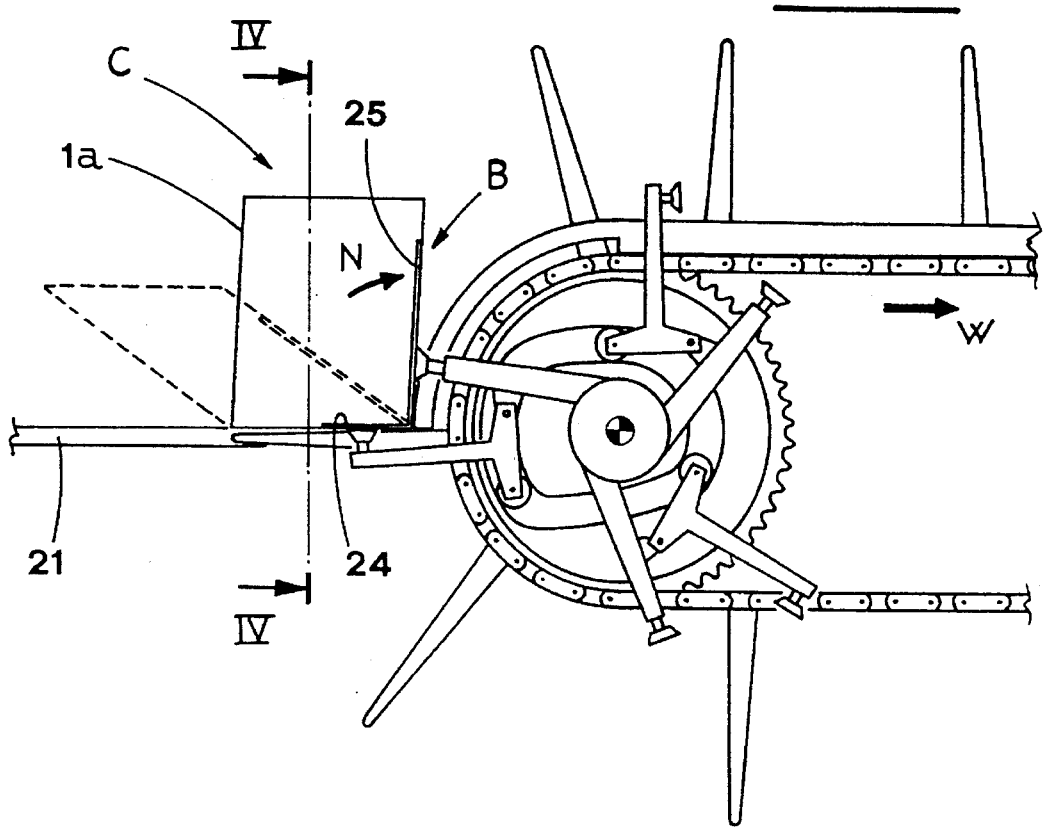

In the same time, the main suction cup 41 and the secondary suction cup 42 of the withdrawing means 40 grip the walls 5 and 6 (see FIG. 3), of the blank 1 bringing it to the starting position C.

The upper blade 25 is again rotated in direction opposite to the direction N, until it returns to the closed position B.

The opening means 22 are translated along the guides 26 until they return to the retracted position.

The said suction cups 41, 42 prevent the container 1*a* from returning to the flat folded condition.

Afterward, the withdrawing means 40 and the chains 32 of the packaging line 30 are operated in synchrony.

The container 1*a* is engaged also by the pair of prongs 35 situated directly thereunder and is moved, by the united action of the prongs and the suction cups 41, 42, along a circumference angle delimited by the guide bar 4 (see FIG. 5), until it reaches the release position D (FIG. 6), corresponding to the conveying surface 31.

In the following step, the container 1*a* is released by the suction cups 41, 42 and is conveyed along the conveying surface 31 while it is maintained in its predetermined position by the prongs 35 and stationary guide 37.

Near the release position D, the shape of the first groove cam 49 causes the secondary suction cup 42 to withdraw with respect to the main suction cup 41 and consequently, to release the wall 6 of the container 1*a*.

After having reached the release position D, the withdrawing means 40 and the chains 32 continue to move until the subsequent pair of suction cups 41 reaches the position G, where they dwell waiting for the next blank, and a subsequent pair of prongs 35 is situated right under the support surface 21.

It is necessary to withdraw the secondary suction cup 42 because otherwise, after having completed the release phase D, the tip speed, higher than the speed of the container 1*a*, could deform and damage the wall 6 of the container 1*a*.

In the other embodiment of the device, the order of all the working steps is the same as described above, but delays of the rotation of the secondary suction cup 42 in the container gripping and releasing steps, are obtained by means of the combined action of the first groove cam 49 and the correction means 60.

During the gripping step, the correction disc 68 rotates in direction V (FIG. 7*a*), guiding the roller 66 along a prefixed section of the second groove cam 67, such that the first arm 61 is set in motion in direction Y by the first rocking rod 62, the second arm 64 and the second rocking rod 65.

The rotation of the secondary suction cup 42 can be delayed by a prefixed value by the action resulting from the shape of the first groove cam 49 and the clockwise rotation of the disc 50, with the first arm 61 rigidly fastened thereto, caused by the motion of the same first arm 61.

During the container release step, with the same mechanism as described above, the roller 66 runs a different section of the second groove cam 67 (FIG. 8*a*), making the first arm 61 move in direction Z that consequently, provokes counterclockwise rotation of the disc 50 that optimises the angular delay of the secondary suction cup 42.

To sum up, the present invention proposes a device for opening and feeding blanks to a packaging line, that is easily adaptable to different shapes and sizes of the blanks by quick and simple setting up operations.

Moreover, the productivity of the described device is high, independently from the size of the blank.

A further advantage of the proposed invention is that it can be applied to similar, already installed, equipments.

In fact, equipments with packaging line of the type described above, can be further equipped with opening means and withdrawing means proposed by the present invention, thus making opening and gripping of the blanks more reliable, and consequently, obtaining higher productivity.

It is understood that what above has been described as a mere, not limitative example, therefore all possible constructive variants are protected by the present technical solution, as described above and claimed in the following.

What is claimed is:

1. A device for opening a flat folded tubular blank to set up a container, said device comprising:

an opening station provided with a support surface substantially horizontal and with opening means situated transversally and parallel to said support surface means for moving, said opening means with stepwise reciprocating motion between a retracted position, in which they are positioned clear of said support surface, and an advanced position in which said opening means are inserted inside said flat folded tubular blank, with said opening means including a lower blade and an upper blade hinged to said lower blade so that it can rotate from a closed position to an opened position to open said blank;

at least one packaging line, provided with a conveying surface situated next to, and at higher level of said support surface with a connecting guide bar therebetween, said packaging line being also provided with two pairs of longitudinal endless chains situated at both sides of said conveying surface, each endless chain being driven stepwise by a related toothed wheel, with the upper runs of said chains substantially flush with said conveying surface, and with each chain being provided with a plurality of prongs turned outward, regularly spaced apart, and defining seats aimed at housing said containers;

withdrawing means, concentric to said toothed wheels and located between them, aimed at engaging adjacent walls of each container in correspondence with said support surface so as to guide them to a starting position in said support surface up to a release position in the conveying surface, said withdrawing means cooperating with said opening means to open the blank.

2. A device according to claim 1, wherein said withdrawing means feature a plurality of pairs of suction cups, situated in radial symmetry with respect to a rotation axis of said chains, and rotated stepwise around the same axis in phase relation with the pairs of chains and with said opening means, said suction cups of each pair including a main suction cup, situated at the end of the respective stationary arm rigidly fastened to a shaft, and a secondary suction cup placed at the outer end of a driven arm made to rotate by said stationary arm, the relative position of the secondary suction cup with respect to the main suction cup being defined in every moment by the action of a first closed loop groove cam.

3. A device, according to claim 2, wherein each driven arm features, at its opposite end, two transversal opposed extensions, respectively a first extension and a second extension, the first extension being pivoted to a bracket rigidly fastened to an intermediate portion of said stationary arm, and the second extension bearing an idling roller aimed at being guided by said first closed loop groove cam made in a disc coaxial with said shaft, so as to change the position of said secondary suction cup.

4. A device according to claim 2, wherein the shape of said first groove cam causes a delay in rotation of the secondary suction cup by a predetermined angle during the gripping step of said container.

5. A device according to claim 2, wherein the shape of said first groove cam causes a delay in rotation of the secondary suction cup by a predetermined angle during the release step of said container.

6. A device according to claim 3, wherein it includes correction means, acting on the said disc to change, in cooperation with the said first groove cam, rotation of the secondary suction cup.

7. A device according to claim 6, wherein said correction means, during a container gripping step, drive said disc to rotate in clockwise direction, in phase relation with motion of the said main suction cup and the secondary suction cup, to delay rotation of the latter by a predetermined angle.

8. A device according to claim 6, wherein the said correction means, during a container release step, drive said disc to rotate in counterclockwise direction, in phase relation with motion of said main suction cup and secondary suction cup, to delay rotation of the latter by a predetermined angle.

9. A device according to claim 6, wherein said correction means include:

a first arm with one end rigidly fastened to said disc, and with the other end slidably connected, by a slot, to an end of a first rocking rod;

a second arm pivoted with one end to said first rocking rod and with the other end to a second rocking rod;

an idling roller, supported by a free end of said second rocking rod and aimed at running in a second closed loop groove cam made in the correction disc rotating in phase relation with the said withdrawing means.

* * * * *